US011825939B1

(12) United States Patent
Tsai

(10) Patent No.: US 11,825,939 B1
(45) Date of Patent: Nov. 28, 2023

(54) FOLDING TABLE

(71) Applicant: SPORT DIVERSIONS INC., Taipei (TW)

(72) Inventor: Yi-Ting Tsai, Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 17/732,555

(22) Filed: Apr. 29, 2022

(51) Int. Cl.
*A47B 3/087* (2006.01)

(52) U.S. Cl.
CPC ..... *A47B 3/087* (2013.01)

(58) Field of Classification Search
CPC ..... A47B 3/087
USPC ..... 108/171, 172
See application file for complete search history.

(56) References Cited

U.S. PATENT DOCUMENTS 1,336,954 A * 4/1920 Gillies ..... A47B 3/04 273/285
2,764,460 A * 9/1956 Nelson ..... A47B 3/087 108/169
5,528,997 A * 6/1996 Miller ..... A47B 3/0912 108/131
2009/0255564 A1* 10/2009 Xie ..... E04H 15/50 135/145
2013/0000528 A1* 1/2013 Jin ..... A47B 3/0915 108/127

FOREIGN PATENT DOCUMENTS

DE 202011050835 U1 * 12/2011 ..... A47B 3/087
KR 20120003865 U * 6/2012

* cited by examiner

*Primary Examiner* — Matthew W Ing

(57) ABSTRACT

A folding table includes a tabletop, a left folding mechanism, a left table leg, a right folding mechanism and a right table leg. The folding table is foldable by coordination of the tabletop, the left folding mechanism, the left table leg, the right folding mechanism and the right table leg. Once folded, the tabletop envelops the left folding mechanism, the left table leg, the right folding mechanism and the right table leg, such that the folding table appears as a long stripe shape and has a rectangular cross section, providing effects of a minimal occupied space and ease of portability when folded, and better stability and a bearing ability when unfolded.

17 Claims, 15 Drawing Sheets

FOLDING TABLE

BACKGROUND OF THE INVENTION

1. Field of the Invention

The present disclosure provides a folding table, and in particular to a folding table that can be folded for storage and unfolded for use.

2. Description of the Related Art

A common conventional folding table is usually formed by one tabletop and two legs, wherein the legs and the tabletop are movably assembled. Thus, the legs can be unfolded at a bottom portion of the tabletop to form a table, or the legs can be folded at the bottom portion of the tabletop so as to achieve the effects of folding and storage.

However, for such conventional folding table that merely has the legs gathered toward the bottom portion of the tabletop, the width of the tabletop when folded is the same as that when unfolded, resulting in drawbacks of occupying a space and lacking ease of portability. Moreover, when the folding table is unfolded, support with respect to the ground is achieved by means of only the legs, and this may lead to inadequacy in both stability and bearing ability.

Therefore, it is an object of the present disclosure to aim to develop and disclose a folding table which appears as a long strip shape and has a rectangular cross section when folded to achieve effects of a minimal occupied space and ease of portability, and better stability and a bearing ability when unfolded.

BRIEF SUMMARY OF THE INVENTION

In view of the issues and drawbacks of the prior art above, it is an object of the inventor with dedicated research and development to provide a folding table, which appears as a long strip shape and has a rectangular cross section when folded to achieve effects of a minimal occupied space and ease of portability, and better stability and a bearing ability when unfolded.

To achieve the above and other objects, the present disclosure provides a folding table including a tabletop, a left folding mechanism, a left table leg, a right folding mechanism and a right table leg. The tabletop includes a center table panel, a first folding table panel and a second folding table panel. The first folding table panel is movably joined on one side of the center table panel, and the second folding table panel is movably joined on the other side of the center tablet panel. The left folding mechanism is arranged on one side of a bottom surface of the center table panel, and includes a left folding seat, a left inclined support, a first left beam, and a second left beam. The left folding seat is arranged at the bottom surface of the center table panel, one end of the left inclined support is movably joined at the left folding seat and presses against the bottom surface of the center table panel, and the first left beam and the second left beam are respectively joined on two sides of the left folding seat and press against the bottom surface of the center table panel. The left table legs are arranged at the left folding mechanism, and includes a left telescopic rod, a left front leg, a left front connection rod, a left front sliding member, a left back leg, a left back connection rod, a left back sliding member and a left telescopic rod fixing portion. The left telescopic rod has one end arranged at the left folding seat, and the other end movably joined on one other end of the left inclined support. The left front leg has one end movably joined at the left folding seat. The left front connection rod has one end movably joined at the first left beam, and the other end movably joined on the other end of the left telescope rod. The left front leg is sleeved at the left front sliding member, and the left front connection rod is movably joined at the left front sliding member. The left back leg has one end movably joined at the left folding seat. The left back connection rod has one end movably joined at the second left beam and the other end movably joined on the other end of the left telescopic rod. The left back leg is sleeved at the left back sliding member, and the left back connection rod is movably joined at the left back sliding member. The left telescopic fixing portion is arranged at the left telescopic rod. The right folding mechanism is arranged on the other side of the bottom surface of the center table panel, and includes a right folding seat, a right inclined support, a first right beam and a second right beam. The right folding seat is arranged at the bottom surface of the center table panel. The right inclined support has one end movably joined at the right folding seat and pressing against the bottom surface of the center table panel. The first right beam and the second right beam are respectively movably joined on two sides of the right folding seat and press against the bottom surface of the center table panel. The right table leg is arranged at the right folding mechanism, and includes a right telescopic rod, a right front leg, a right front connection rod, a right front sliding member, a right back leg, a right back connection rod, a right back sliding member and a right telescopic rod fixing portion. The right telescopic rod has one end movably joined at the first right unfolding seat, and the other end movably joined on the other end of the right inclined support. The right front leg has one end movably joined at the right folding seat. The right front connection rod has one end movably joined at the first right beam, and the other end movably joined at the other end of the right telescopic rod. The right front leg is sleeved at the right front sliding member, and the right front connection rod is movably joined at the right front sliding member. The right back leg has one end movably joined at the right folding seat. The right back connection rod has one end movably joined at the second right beam and the other end movably joined on the other end of the right telescopic rod. The right back sliding member is sleeved at the right back leg, and the right back sliding member is movably joined at the right back connection rod. The right telescopic rod fixing portion is arranged at the right telescopic rod.

In the folding table according to one embodiment, the tabletop further includes a bottom support bar, which is movably joined at the bottom surface of the center table panel by a pivot portion.

In the folding table according to one embodiment, a first limiting portion is arranged at the bottom surface of the first folding table panel, a second limiting portion is arranged at a bottom surface of the second folding table panel, and two ends of the bottom support bar are respectively embedded into the first limiting portion and the second limiting portion.

In the folding table according to one embodiment, a first fastening portion and a second fastening portion are arranged at the bottom surface of the first folding table panel, a third fastening portion and a fourth fastening portion are arranged at the bottom surface of the second folding table panel, the first left beam and the second left beam are respectively fastened at the first fastening portion and the third fastening portion, and the first right beam and the second right beam are respectively fastened at the second fastening portion and the fourth fastening portion.

In the folding table according to one embodiment, the left folding seat is provided with a first rotating shaft, a first pivot joint, a second pivot joint, a third pivot joint, a fourth pivot joint and a first sleeve. The first rotating shaft is arranged on an outer side of the left folding seat, the third pivot joint is arranged on one end of the left folding seat, the fourth pivot joint is arranged on the other end of the left folding seat, the first pivot joint is adjacent to the third pivot joint, and the second pivot joint is adjacent to the fourth pivot. The first rotating shaft is movably joined at the left inclined support, the first left beam has one end movably joined at the first pivot joint, the second left beam has one end movably joined at the second pivot joint, the left front leg has one end movably joined at the third pivot joint, the left back leg has one end movably joined at the fourth pivot joint, and the left telescopic rod has one end sleeved at the first sleeve.

In the folding table according to one embodiment, the left inclined support is provided with two left support cross arms and two left support inclined arms. The left support cross arms are movably joined respectively at the left support inclined arms and the first rotating shaft, and the left telescopic rod has the other end movably joined at the left support inclined arms.

In the folding table according to one embodiment, the left telescopic rod is provided with a left outer tube, a left inner tube, a first connection member, a fifth pivot joint and a sixth pivot joint. The left inner tube is sleeved in the left outer tube. The first connection member is arranged on an outer end of the left inner tube, the fifth pivot joint is arranged on one side of the first connection member, and the sixth pivot joint is arranged on the other side of the first connection member. The left outer tube has one end is arranged at the left folding seat, and the left telescopic rod fixing portion is arranged at the left outer tube. The left front connection rod has the other end movably joined at the fifth pivot joint, and the left back connection rod has the other end movably joined at the sixth pivot joint.

In the folding table according to one embodiment, the left telescopic rod fixing portion includes a first seat, a first latch pin, a first elastic member and a first pull member. The first seat is located on one end of the left outer tube. The first latch pin is arranged at the first seat. The first elastic member is arranged between the first seat and the first latch pin. The first pull member is arranged at the first latch pin. A first limiting hole and a second limiting hole corresponding to each other are provided at the left outer tube and the left inner tube. The first latch pin is fastened with or unfastened from the first limiting hole and the second limiting hole.

In the folding table according to one embodiment, the left front sliding member includes a second sleeve and a seventh pivot joint. The seventh pivot joint is arranged on one side of the second sleeve, the left front leg is movably inserted at the second sleeve, and the left front connection rod is movably joined at the seventh pivot joint.

In the folding table according to one embodiment, the left back sliding member includes a third sleeve and an eighth pivot joint. The eighth pivot joint is arranged on one side of the third sleeve, the left back leg is movably inserted at the third sleeve, and the left back connection rod is movably joined at the eighth pivot joint.

In the folding table according to one embodiment, the right folding seat is provided with a second rotating shaft, a ninth pivot joint, a tenth pivot joint, an eleventh pivot joint, a twelfth pivot joint and a fourth sleeve. The second rotating shaft is arranged on an outer side of the right folding seat, the eleventh pivot joint is arranged on one end of the right folding seat, the twelfth pivot joint is arranged on the other end of the right folding seat, the ninth pivot joint is adjacent to the eleventh pivot joint, and the tenth pivot joint is adjacent to the twelfth pivot. The second rotating shaft is movably joined at the right inclined support, the first right beam has one end movably joined at the ninth pivot joint, the second right beam has one end movably joined at the tenth pivot joint, the right front leg has one end movably joined at the eleventh pivot joint, the right back leg has one end movably joined at the twelfth pivot joint, and the right telescopic rod has one end sleeved at the fourth sleeve.

In the folding table according to one embodiment, the right inclined support is provided with two right support cross arms and two right support inclined arms. The right support cross arms are movably joined respectively at the right support inclined arms and the second rotating shaft, and the right telescopic rod has the other end movably joined at the right support inclined arms.

In the folding table according to one embodiment, the right telescopic rod is provided with a right outer tube, a right inner tube, a second connection member, a thirteenth pivot joint and a fourteenth pivot joint. The right inner tube is sleeved in the right outer tube. The second connection member is arranged on an outer end of the right inner tube, the thirteenth pivot joint is arranged on one side of the second connection member, and the fourteenth pivot joint is arranged on the other side of the second connection member. The right outer tube has one end arranged at the right folding seat, and the right telescopic rod fixing portion is arranged at the right outer tube. The right front connection rod has the other end movably joined at the thirteenth pivot joint, and the right back connection rod has the other end movably joined at the fourteenth pivot joint.

In the folding table according to one embodiment, the right telescopic rod fixing portion includes a second seat, a second latch pin, a second elastic member and a second pull member. The second seat is located on one end of the right outer tube. The second latch pin is arranged at the second seat. The second elastic member is arranged between the second seat and the second latch pin. The second pull member is arranged at the second latch pin. A third limiting hole and a fourth limiting hole corresponding to each other are respectively provided at the right outer tube and the right inner tube. The second latch pin is fastened with or unfastened from the third limiting hole and the fourth limiting hole.

In the folding table according to one embodiment, the right front sliding member includes a fifth sleeve and a fifteenth pivot joint. The fifteenth pivot joint is arranged on one side of the fifth sleeve, the right front leg is movably inserted at the fifth sleeve, and the right front connection rod is movably joined at the fifteenth pivot joint.

In the folding table according to one embodiment, the right back sliding member includes a sixth sleeve and a sixteenth pivot joint. The sixteenth pivot joint is arranged on one side of the sixth sleeve, the right back leg is movably inserted at the sixth sleeve, and the right back connection rod is movably joined at the sixteenth pivot joint.

In the folding table according to one embodiment, a first handle is arranged on one side of the first folding table panel, and a second handle is arranged on one side of the second folding table panel.

Thus, the folding table of the present disclosure is foldable by means of coordination of the tabletop, the left folding mechanism, the left table leg, the right folding mechanism and the right table leg. Once folded, the tabletop envelops the left folding mechanism, the left table leg, the right folding mechanism and the right table leg, such that the folding table appears as a long stripe shape and has a rectangular cross section, achieving the object of providing effects of a minimal occupied space and ease of portability when folded, and better stability and a bearing ability when unfolded.

DETAILED DESCRIPTION OF THE INVENTION

Figure 1:
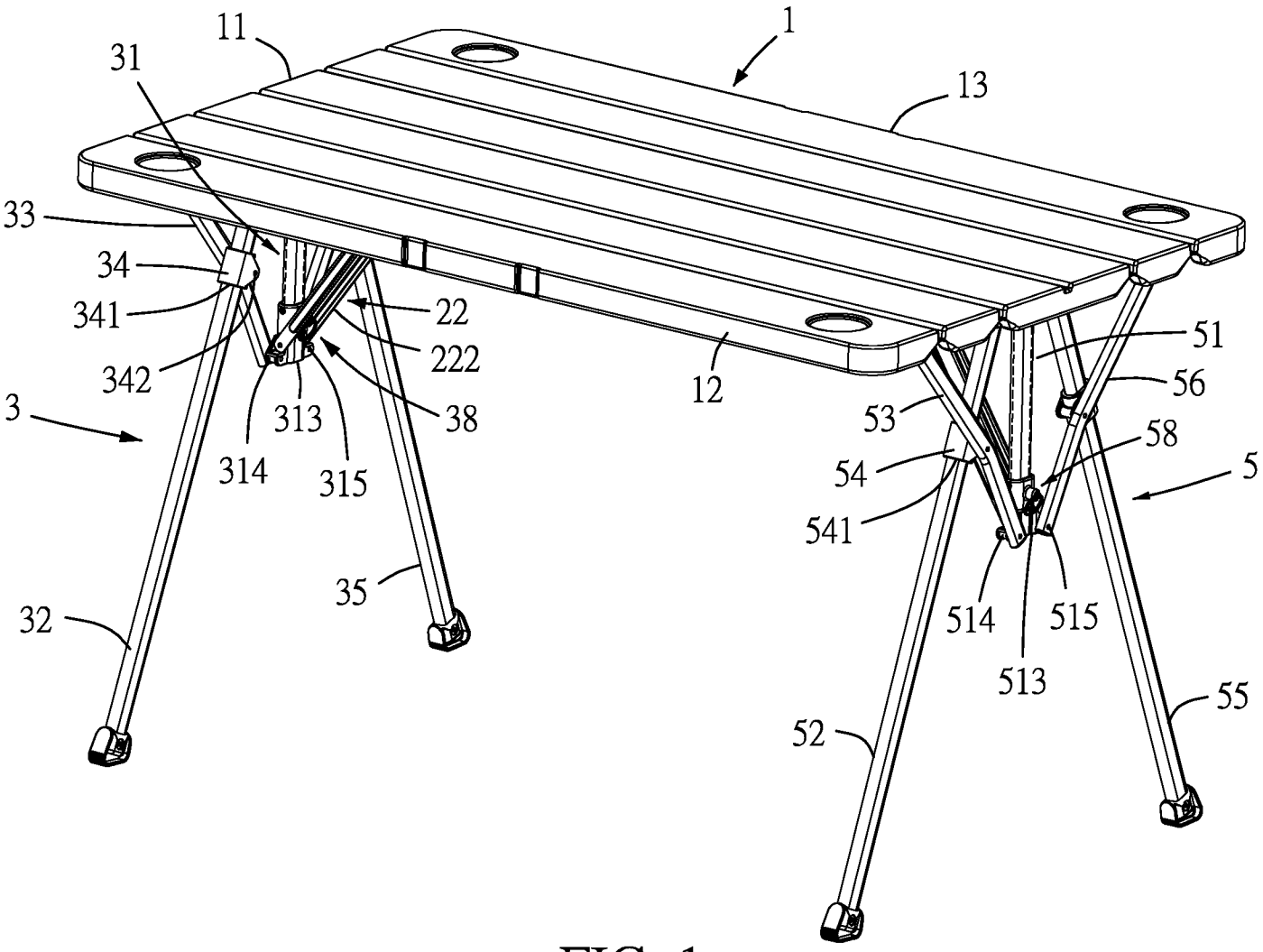
FIG. 1 is a three-dimensional schematic diagram of an appearance of the present disclosure.

To facilitate understanding of the object, characteristics and effects of this present disclosure, embodiments together with the attached drawings for the detailed description of the present disclosure are provided.

Referring to FIG. 1 to FIG. 4, as shown in the drawings, the present disclosure provides a folding table including a tabletop 1, a left folding mechanism 2, a left table leg 3, a right folding mechanism 4 and a right table leg 5.

The tabletop 1 includes a center table panel 11, a first folding table panel 12 and a second folding table panel 13. The first folding table panel 12 is movably joined on one side of the center table panel 11, and the second folding table panel 13 is movably joined on the other side of the center table panel 11.

The left folding mechanism 2 is arranged on one side of a bottom surface of the center table panel 11. The left folding mechanism 2 includes a left folding seat 21, a left inclined support 22, a first left beam 23 and a second left beam 24. The left folding seat 21 is arranged at the bottom surface of the center table panel 11. The left inclined support 22 has one end movably joined at the left folding seat 21 and pressing against the bottom surface of the center table panel 11. The first left beam 23 and the second left beam 24 are respectively movably joined on two sides of the left folding seat 21 and press against the bottom surface of the center table panel 11.

The left table leg 3 is arranged at the left folding mechanism 2. The left table leg 3 includes a left telescopic rod 31, a left front leg 32, a left front connection rod 33, a left front sliding member 34, a left back leg 35, a left back connection rod 36, a left sliding member 37 and a left telescopic rod fixing portion 38. The left telescopic rod 31 has one end arranged at the left folding seat 21, and the other end movably joined at the other end of the left inclined support 22. The left front leg 32 has one end movably joined at the left folding seat 21. The left front connection rod 33 has one end movably joined at the first left beam 23, and has the other end movably joined on the other end of the left telescopic rod 31. The left front leg 32 is sleeved at the left front sliding member 34, and the left front connection rod 33 is movably joined at the left front sliding member 34. The left back leg 35 has one end movably joined at the left folding seat 21. The left back connection rod 36 has one end movably joined at the second left beam 24, and the other end movably joined at the other end of the left telescopic rod 31. The left back leg 35 is sleeved at the left back sliding member 37, and the left back connection rod 36 is movably joined at the left back sliding member 37. The left telescopic rod fixing portion 38 is arranged at the left telescopic rod 31.

The right folding mechanism 4 is arranged on the other side of the bottom surface of the center table panel 11. The right folding mechanism 4 includes a right folding seat 41, a right inclined support 42, a first right beam 43 and a second right beam 44. The right folding seat 41 is arranged at the bottom surface of the center table panel 11. The right inclined support 42 has one end movably joined at the right folding seat 41 and pressing against the bottom surface of the center table panel 11. The first right beam 43 and the second right beam 44 are respectively movably joined on two sides of the right folding seat 41 and press against the bottom surface of the center table panel 11.

The right table leg 5 is arranged at the right folding mechanism 4. The right table leg 5 includes a right telescopic rod 51, a right front leg 52, a right front connection rod 53, a right front sliding member 54, a right back leg 55, a right back connection rod 56, a right sliding member 57 and a right telescopic rod fixing portion 58. The right telescopic rod 51 has one end arranged at the right folding seat 41, and the other end movably joined at the other end of the right inclined support 42. The right front leg 52 has one end movably joined at the right folding seat 41. The right front connection rod 53 has one end movably joined at the first right beam 43, and has the other end movably connected to the other end of the right telescopic rod 51. The right front leg 52 is sleeved at the right front sliding member 54, and the right front connection rod 53 is movably joined at the right front sliding member 54. The right back leg 55 has one end movably joined at the right folding seat 41. The right back connection rod 56 has one end movably joined at the second right beam 44, and the other end movably joined at the other end of the right telescopic rod 51. The right back sliding member 57 is sleeved at the right back leg 55, and the right back sliding member 57 is movably joined at the right back connection rod 56. The right telescopic rod fixing portion 58 is arranged at the right telescopic rod 51.

Figure 2:
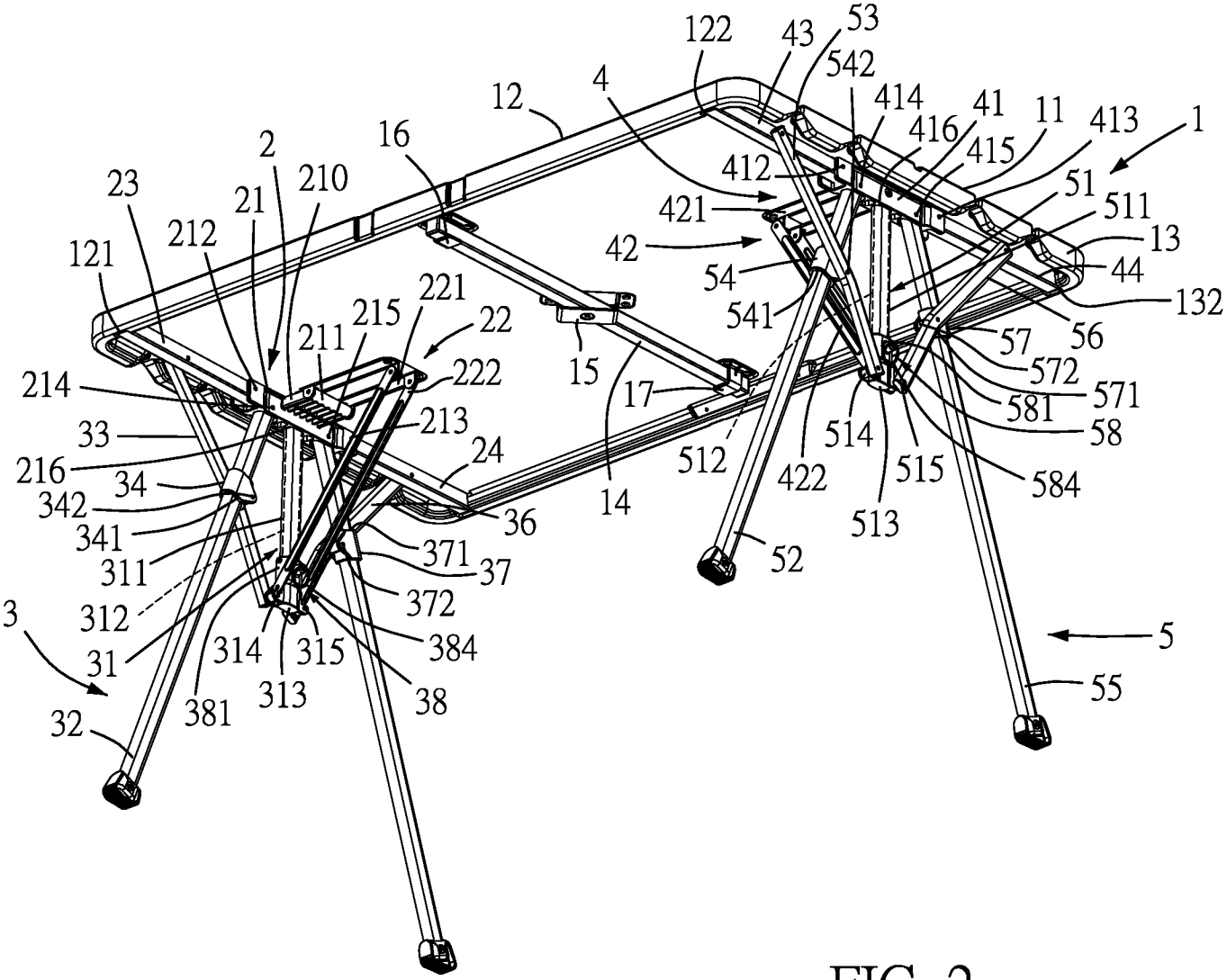
FIG. 2 is another three-dimensional schematic diagram of an appearance of the present disclosure.

When the tabletop 1, the left folding mechanism 2, the left table leg 3, the right folding mechanism 4 and the right table leg 5 are unfolded, the present disclosure can be used as a table. Moreover, with the coordination of the tabletop 1, the left folding mechanism 2, the left table leg 3, the right folding mechanism 4 and the right table leg 5, the present disclosure provides better stability and bearing ability when unfolded (as shown in FIG. 1 and FIG. 2).

As shown in FIG. 4 to FIG. 8, to fold the present disclosure, the left telescopic rod 31 is released from the left telescopic rod fixing portion 38, so that the left folding seat 21 of the left folding mechanism 2 folds toward the bottom surface of the tabletop 1, allowing the left telescopic rod 31 to extend long and at the same time drive the left inclined support 22, the first left beam 23, the second left beam 24, the left front leg 32, the left front connection rod 33, the left back leg and the left back connection rod 36, further causing the left inclined support 22, the first left beam 23, the second left beam 24, the left front leg 32, the left front connection rod 33, the left back leg 35 and the left back connection rod 36 to gather with one another at the bottom surface of the center table panel 11 and to appear a folded state. Moreover, right telescopic rod 51 is released from the right telescopic rod fixing portion 58, so that the right folding seat 41 of the right folding mechanism 4 folds toward the bottom surface of the tabletop 1, allowing the right telescopic rod 51 to extend long and at the same time drive the right inclined support 42, the first right beam 43, the second right beam 44, the right front leg 52, the right front connection rod 53, the right back leg 55 and the right back connection rod 56, further causing the right inclined support 42, the first right beam 43, the second right beam 44, the right front leg 52, the right front connection rod 53, the right back leg 55 and the right back connection rod 56 to gather with one another at the bottom surface of the center table panel 11 and to appear a folded state.

Once the left table leg 3 and the right table leg 5 are folded as described above, the left table leg 3 and the right table leg 5 may be layered on each other. In an embodiment of the present disclosure, the left folding seat 21 has an extension section 210, and so the length of the left folding seat 21 is longer than that of the right folding seat 41. Thus, after the right table leg 5 is folded with coordination of the right folding mechanism 4, the left table leg 3 is folded with coordination of the left folding mechanism 2, such that the left table leg 3 is layered over the right table leg 5.

Figure 11:
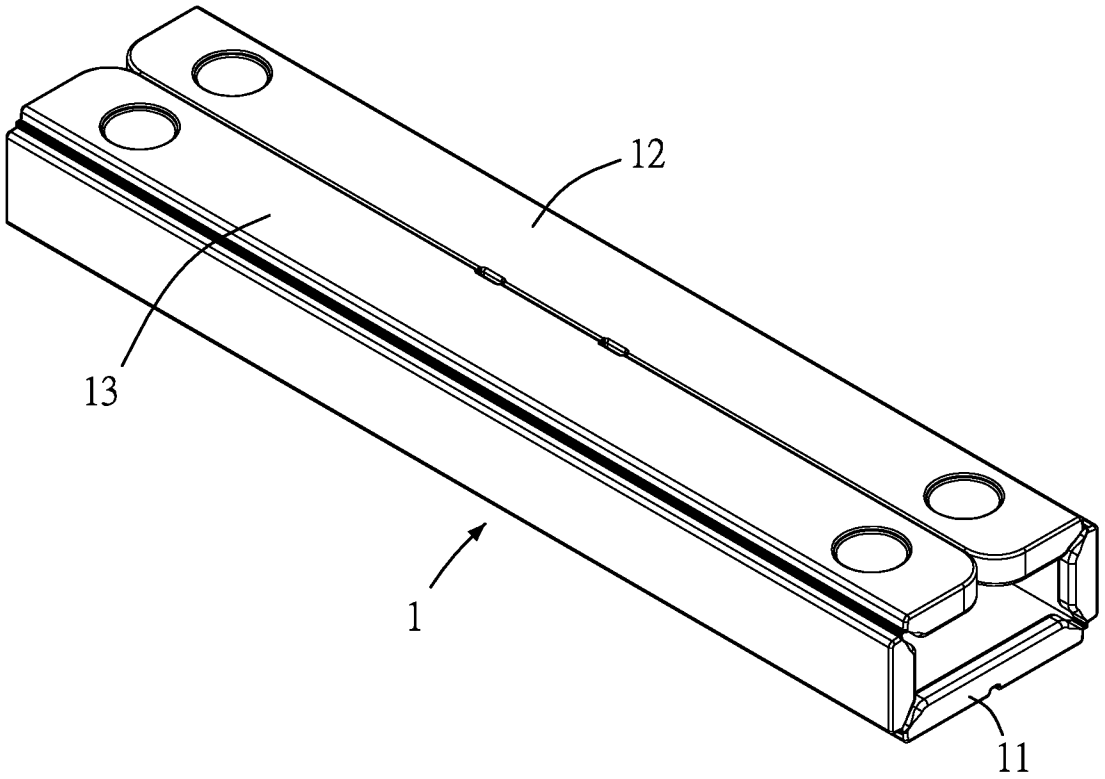
FIG. 11 is a seventh schematic diagram of the present disclosure in a folded state.
Figure 12:
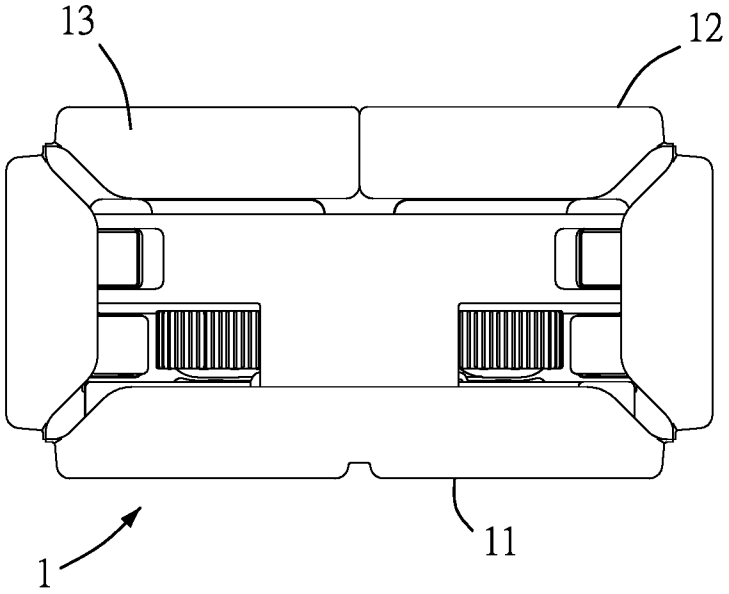
FIG. 12 is an eight schematic diagram of the present disclosure in a folded state.

As shown in FIG. 9 to FIG. 12, once folding of the left table leg 3 and the right table leg 5 is complete, the first folding table panel 12 and the second folding table panel 13 are folded in a direction of the center table panel 11, such that the center table panel 11, the first folding table panel 12 and the second folding table panel 13 envelope the left folding mechanism 2, the left table leg 3, the right folding mechanism 4 and the right table leg 5. Thus, the folding table appears a long stripe shape and has a rectangular cross section (quadrilateral), providing effects of a minimal occupied space and ease of portability (as shown in FIG. 11 and FIG. 12).

Figure 3:
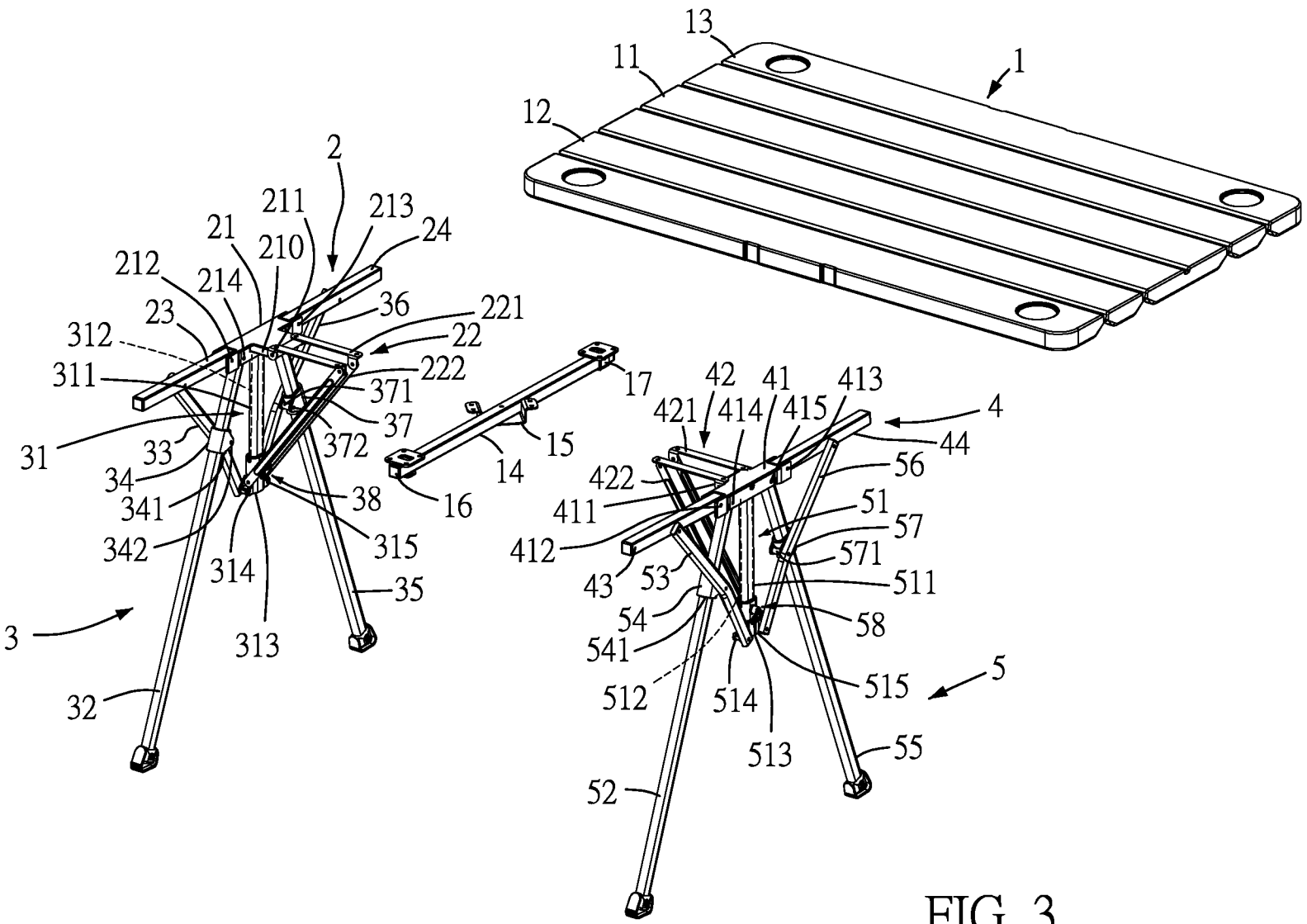
FIG. 3 is an exploded three-dimensional schematic diagram of the present disclosure.
Figure 4:
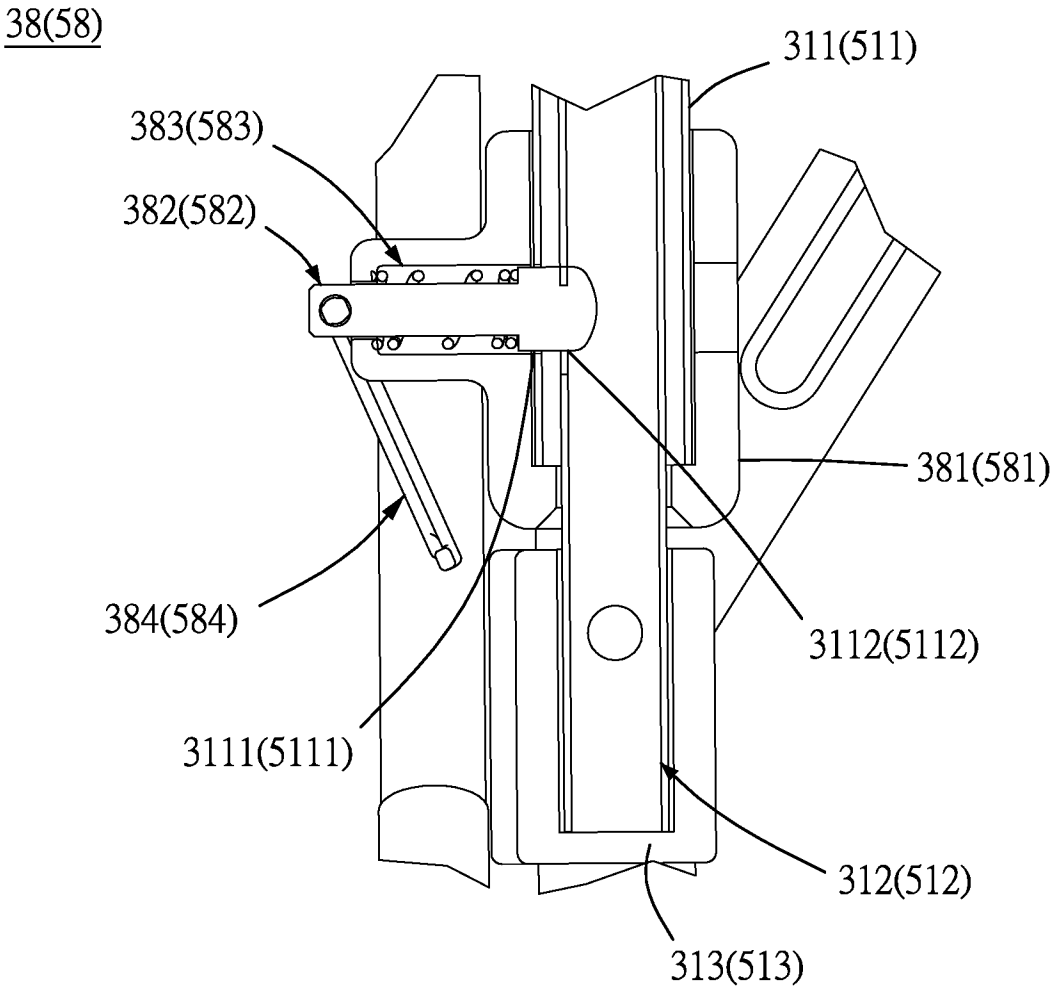
FIG. 4 is a schematic diagram of a left telescopic rod fixing portion and a right telescopic rod fixing portion of the present disclosure.
Figure 5:
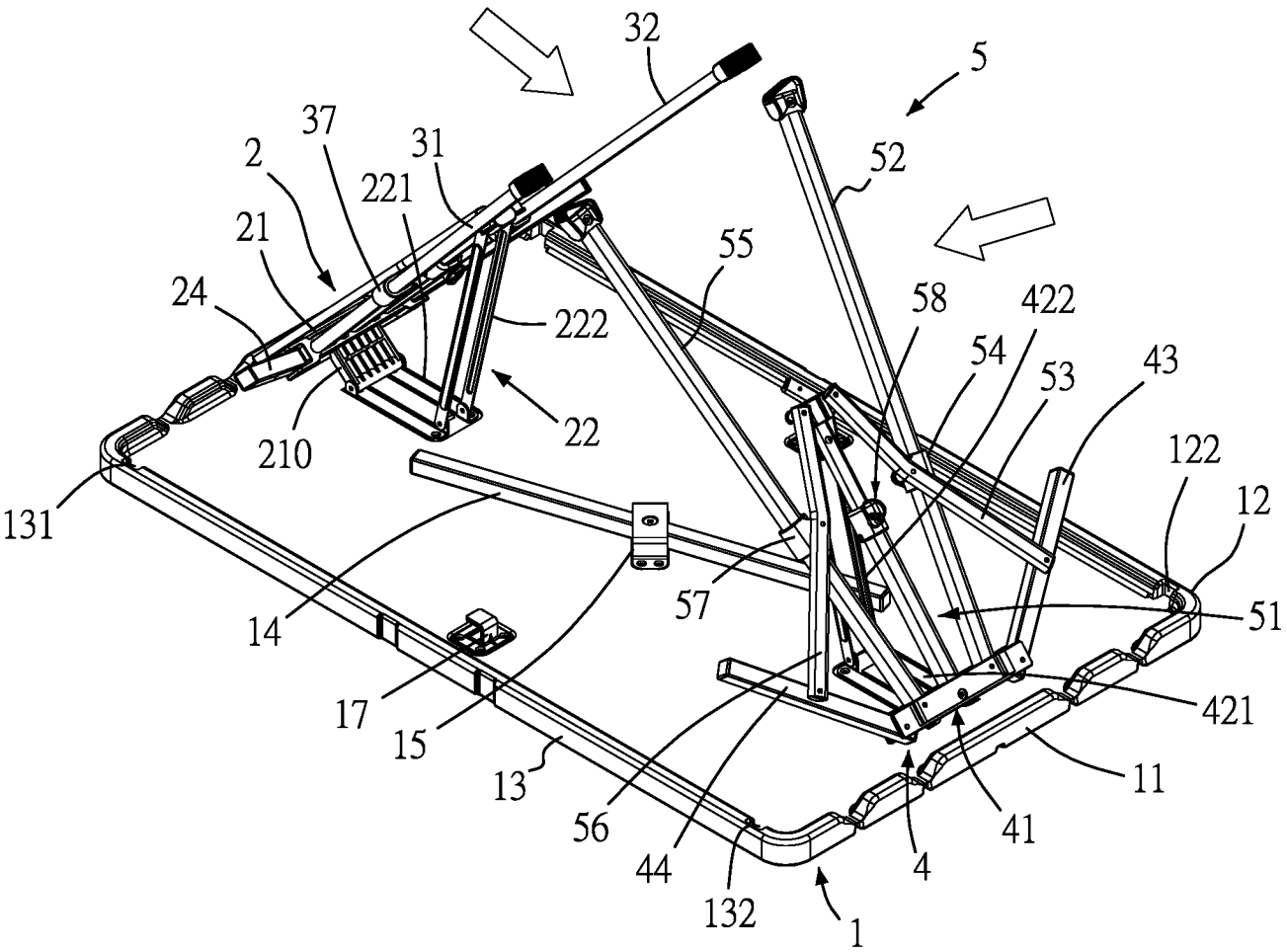
FIG. 5 is a first schematic diagram of the present disclosure in a folded state.
Figure 6:
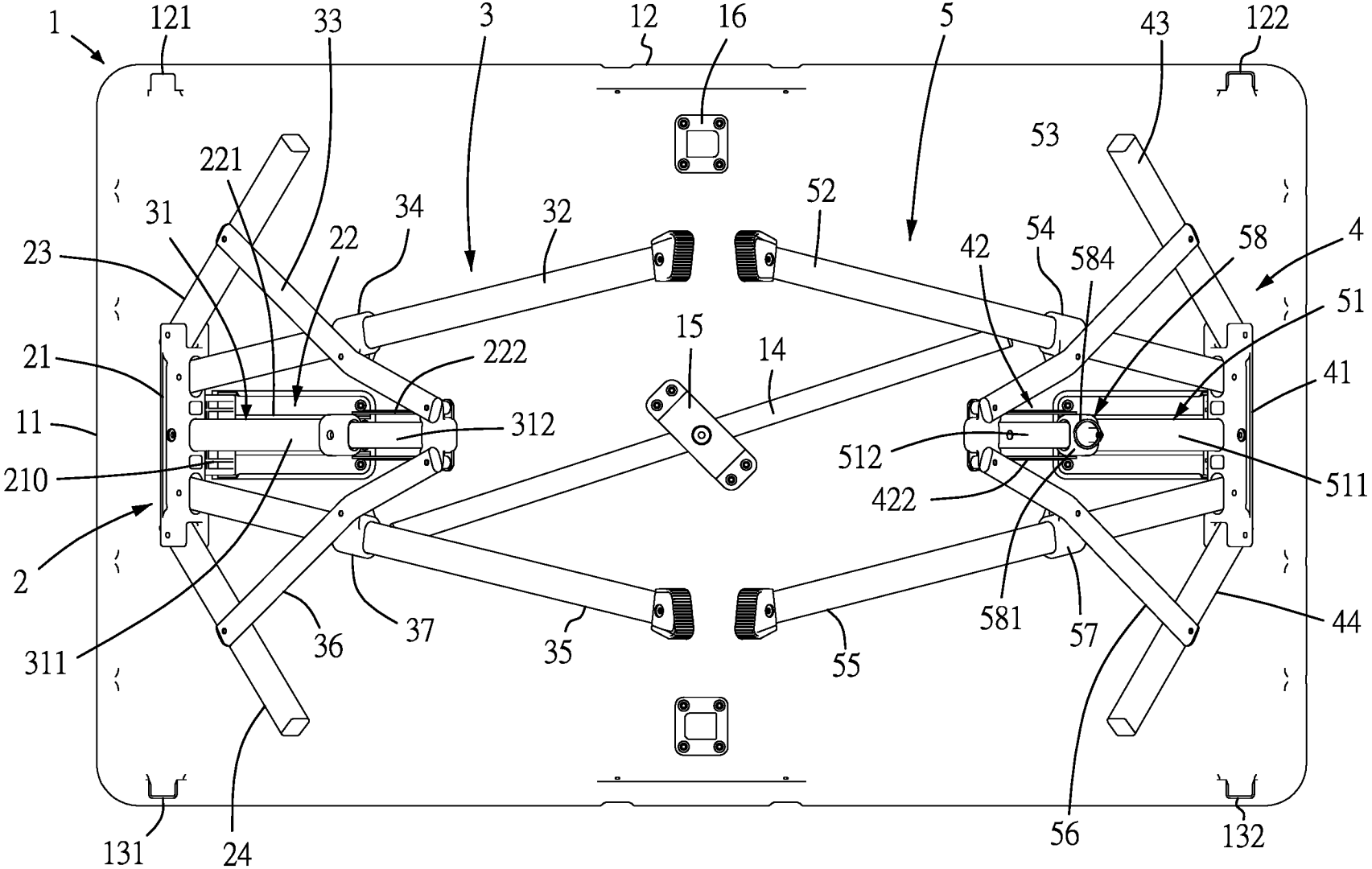
FIG. 6 is a second schematic diagram of the present disclosure in a folded state.
Figure 7:
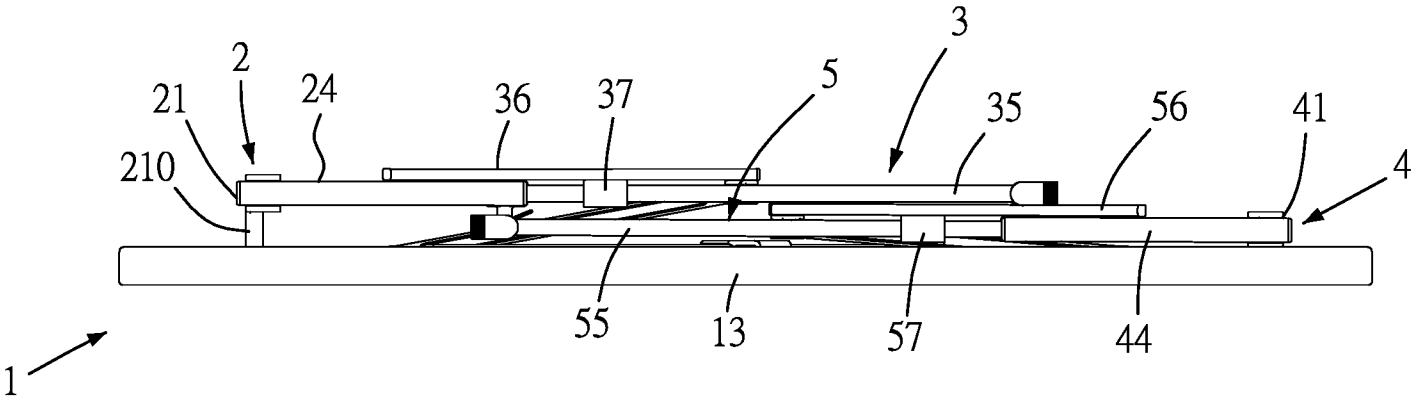
FIG. 7 is a third schematic diagram of the present disclosure in a folded state.
Figure 8:
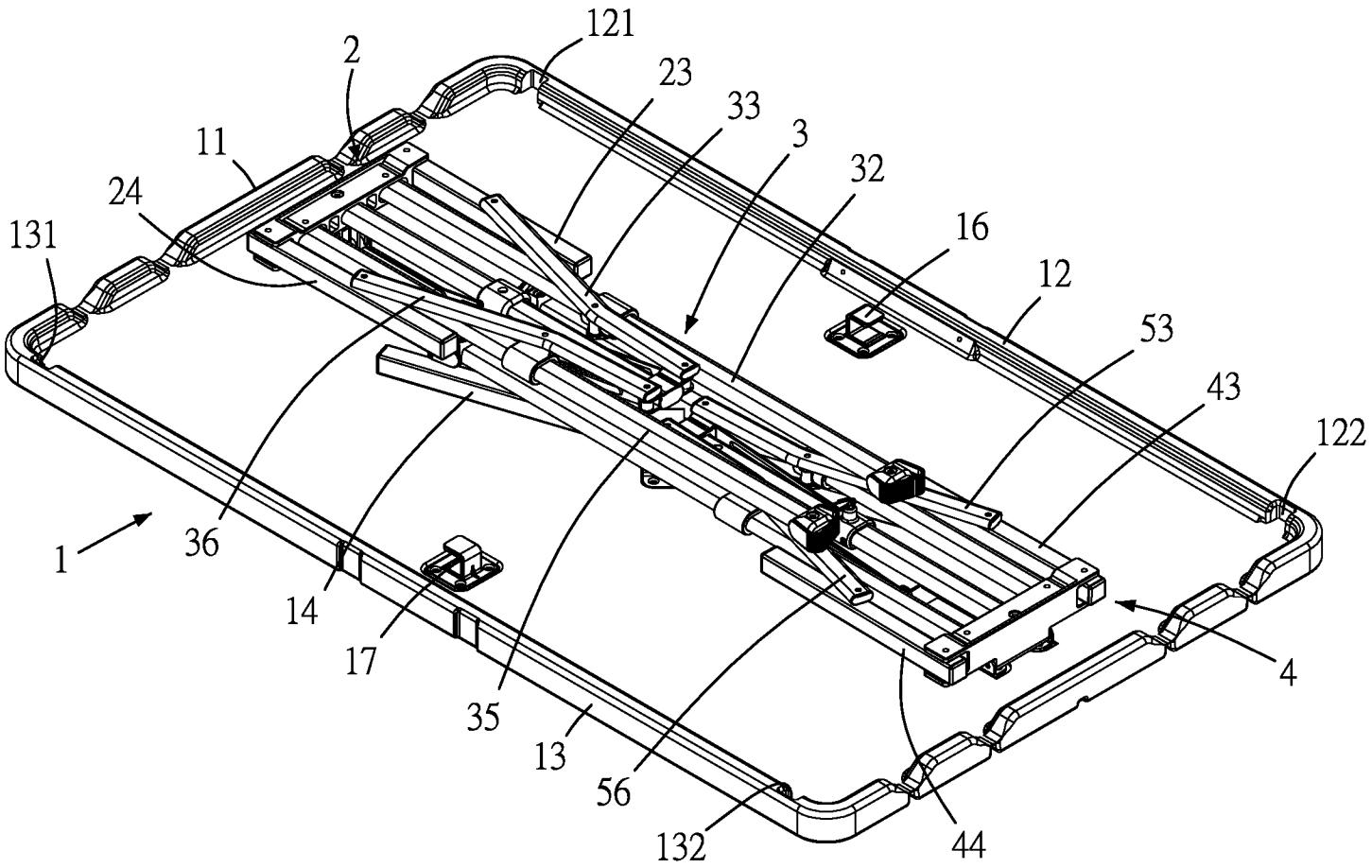
FIG. 8 is a fourth schematic diagram of the present disclosure in a folded state.
Figure 9:
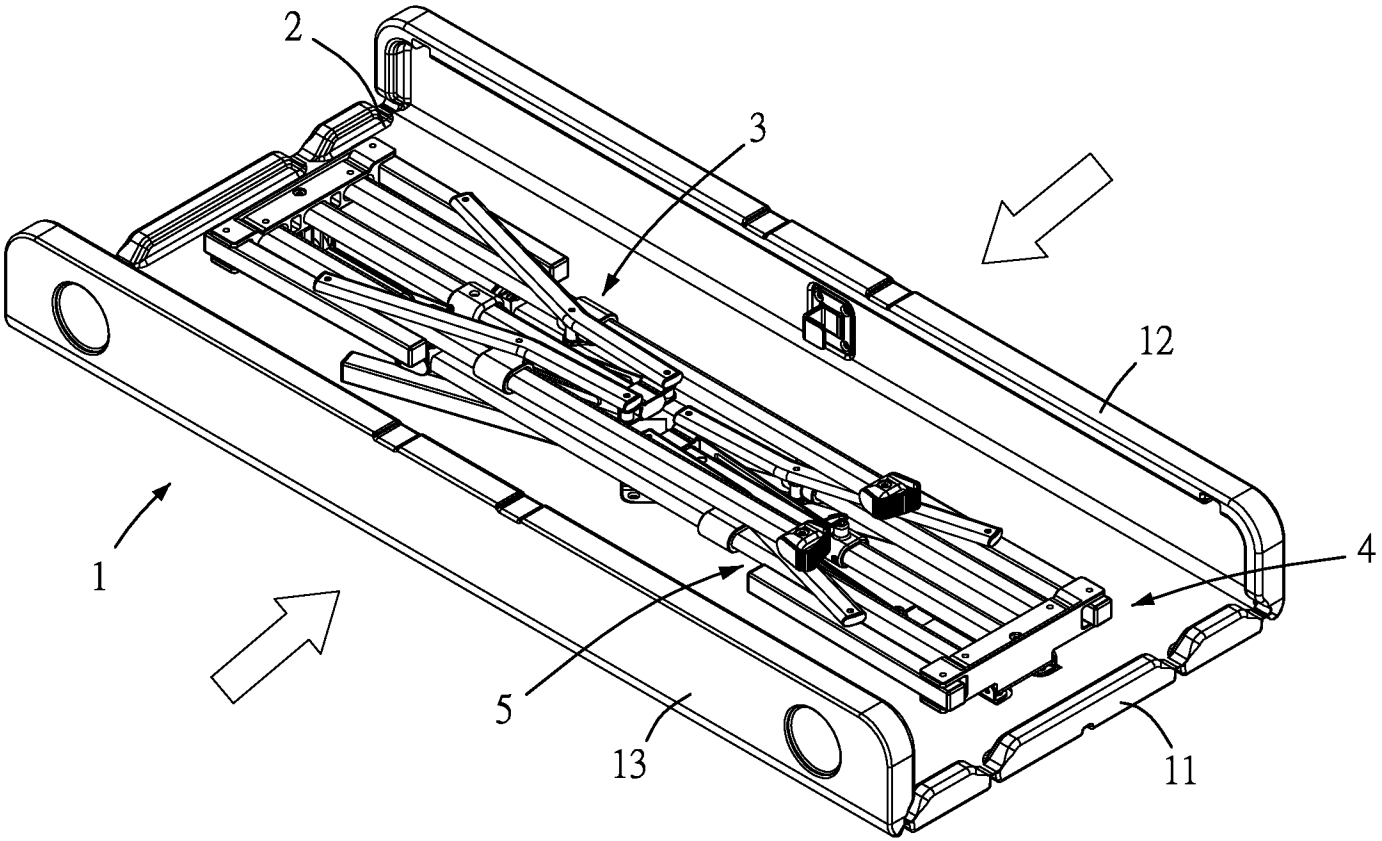
FIG. 9 is a fifth schematic diagram of the present disclosure in a folded state.
Figure 10:
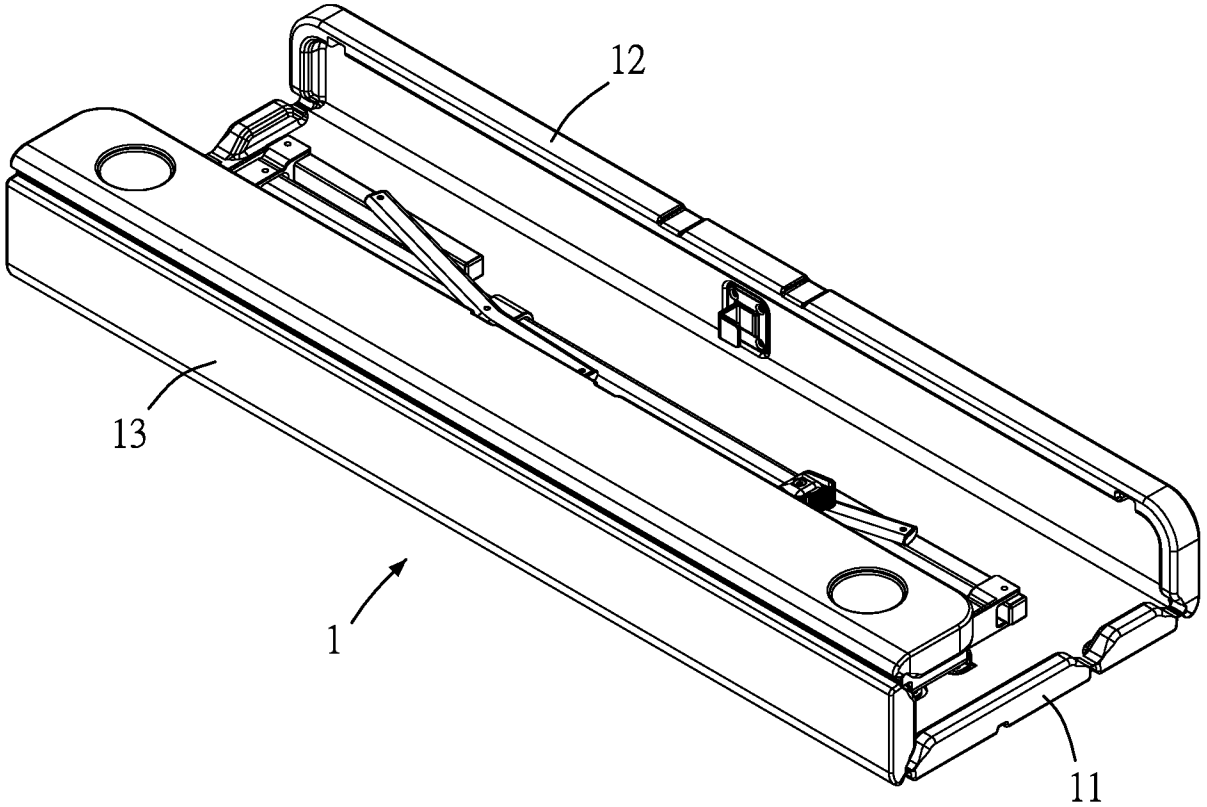
FIG. 10 is a sixth schematic diagram of the present disclosure in a folded state.

As shown in FIG. 1 to FIG. 3, in one embodiment of the present disclosure, the tabletop 1 further includes a bottom support bar 14. The bottom support bar 14 is movably joined at the bottom surface of the center table panel 11 by a pivot portion 15, which is in a slightly inclined state. Moreover, a first limiting portion 16 is provided at a bottom surface of the first folding panel 12, and a second limiting portion 17 is provided at a bottom surface of the second folding panel 13. Thus, when the tabletop 1 is unfolded for use, with the coordination of the pivot portion 15, the bottom support bar 14 can be rotated to support the center table panel 11, the first folding table panel 12 and the second folding table panel 13, and allow two ends of bottom support bar 14 be respectively embedded into bottom surfaces of the first limiting portion 16 and the second limiting portion 17 for support, further providing the tabletop 1 with better stability and bearing ability by means of the coordination of the bottom support bar 14 and the pivot portion 15. When folded, the bottom support bar 14 may be moved into the bottom surface of the center table panel 11 (as shown in FIG. 5 and FIG. 6) with the coordination of the pivot portion 15, achieving effects of being readily foldable.

As shown in FIG. 1 to FIG. 3, in one embodiment of the present disclosure, a first fastening portion 121 and a second fastening portion 122 are arranged at the bottom surface of the first folding table panel 12, and a third fastening portion 131 and a fourth fastening portion 132 are arranged at the bottom surface of the second folding table panel 13. Thus, when the tabletop 1 is unfolded for use, the left folding mechanism 2 is allowed to be fastened with the first fastening portion 121 and the third fastening portion 131 respectively by the first left beam 23 and the second left beam 24, and the right folding mechanism 4 is allowed to be fastened with the second fastening portion 122 and the fourth fastening portion 132 respectively by the first right beam 43 and the second right beam 44, such that the left folding mechanism 2 maintains the stability and bearing ability of the left table leg 3, and the right folding mechanism 4 maintains the stability and bearing ability of the right table leg 5.

As shown in FIG. 1 to FIG. 3, in one embodiment of the present disclosure, the left folding seat 21 is provided with a first rotating shaft 211, a first pivot joint 212, a second pivot joint 213, a third pivot joint 214, a fourth pivot joint 215 and a first sleeve 216. The first rotating shaft 211 is arranged on an outer side of the left folding seat 21, the third pivot joint 214 is arranged on one end of the left folding seat 21, the fourth pivot joint 215 is arranged on the other end of the left folding seat 21, the first pivot joint 212 is adjacent to the third pivot joint 214, and the second pivot joint 213 is adjacent to the fourth pivot 215. The first rotating shaft 211 is movably joined at the left inclined support 22, the first left beam 23 has one end movably joined at the first pivot joint 212, the second left beam 24 has one end movably joined at the second pivot joint 213, the left front leg 32 has one end movably joined at the third pivot joint 214, the left back leg 35 has one end movably joined at the fourth pivot joint 215, and the left telescopic rod 31 has one end sleeved at the first sleeve 216. Thus, when folded or unfolded, the left inclined support 22, the first left beam 23, the second left beam 24, the left telescopic rod 31, the left front leg 32 and the left back leg 35 can be moved with the coordination of the first rotating shaft 211, the first pivot joint 212, the second pivot joint 213, the third pivot joint 214, the fourth pivot joint 215 and the first sleeve 216, further providing the left folding mechanism 2 and the left table leg 3 with better stability and bearing ability when unfolded in addition to achieving the effect of smoothly moving the left folding mechanism 2 and the left table leg 3.

As shown in FIG. 1 to FIG. 3, in one embodiment of the present disclosure, the left inclined support 22 is provided with two left support cross arms 221 and two left support inclined arms 222. The left support cross arms 221 are movably joined respectively at the left support inclined arms 222 and the first rotating shaft 211, and the left telescopic rod 31 has the other end movably joined at the left support inclined arms 222. Thus, when the left inclined support 22 is folded or unfolded, with the coordination of the first rotating shaft 211, the left support cross arms 221 and the left support inclined arms 222, the left folding mechanism 2 and the left table leg 3 are provided with better stability and bearing ability when unfolded in addition to achieving the effect of smoothly moving the left folding mechanism 2 and the left table leg 3.

As shown in FIG. 1 to FIG. 3, in one embodiment of the present disclosure, the left telescopic rod 31 is provided with a left outer tube 311, a left inner tube 312, a first connection member 313, a fifth pivot joint 314 and a sixth pivot joint 315. The left inner tube 312 is sleeved in the left outer tube 311. The first connection member 313 is arranged on an outer end of the left inner tube 312, the fifth pivot joint 314 is arranged on one side of the first connection member 313, and the sixth pivot joint 315 is arranged on the other side of the first connection member 313. The left outer tube 311 has one end arranged at the left folding seat 21, and the left telescopic rod fixing portion 38 is arranged at the left outer tube 311. The left front connection rod 33 has the other end movably joined at the fifth pivot joint 314, and the left back connection rod 36 has the other end movably joined at the sixth pivot joint 315. Thus, when the left telescopic rod 31 is folded or unfolded, the left front leg 32, the left front connection rod 33, the left back leg 35 and the left back connection rod 36 can be collaterally moved with the coordination of the left outer tube 311, the left inner tube 312, the first connection member 313, the fifth pivot joint 314 and the sixth pivot joint 315, further providing the left folding mechanism 2 and the left table leg 3 with better stability and bearing ability when unfolded in addition to achieving the effect of smoothly moving the left folding mechanism 2 and the left table leg 3.

As shown in FIG. 1 to FIG. 4, in one embodiment of the present disclosure, the left telescopic rod fixing portion 38 includes a first seat 381, a first latch pin 382, a first elastic member 383 and a first pull member 384. The first seat 381 is located on one end of the left outer tube 311. The first latch pin 382 is arranged at the first seat 381. The first elastic member 383 is arranged between the first seat 381 and the first latch pin 382. The first pull member 384 is arranged at the first latch pin 382. A first limiting hole 3111 and a second limiting hole 3112 corresponding to each other are provided at the left outer tube 311 and the left inner tube 312. The first latch pin 382 is fastened with or unfastened from the first limiting hole 3111 and the second limiting hole 3112. Thus, when the left table leg 3 is folded or unfolded, the first pull member 384 of the left telescopic rod fixing portion 38 is used to drive the first latch pin 382 (and to cause the first elastic member 383 to be in a compressed or expanded state), so as to limit or release the left outer tube 311 and the left inner tube 312 of the left telescopic rod 31, allowing the left telescopic rod 31 to act and drive the left inclined support 22, the first left beam 23, the second left beam 24, the left front leg 32, the left front connection rod 33, the left back leg 35 and the left back connection rod 36, further providing the left folding mechanism 2 and the left table leg 3 with better stability and bearing ability when unfolded in addition to achieving the effect of a smooth movement for the left folding mechanism 2 and the left table leg 3.

As shown in FIG. 1 to FIG. 3, in one embodiment of the present disclosure, the left front sliding member 34 includes a second sleeve 341 and a seventh pivot joint 342. The seventh pivot joint 342 is arranged on one side of the second sleeve 341, the left front leg 32 is movably inserted at the second sleeve 341, and the left front connection rod 33 is movably joined at the seventh pivot joint 342. The left back sliding member 37 includes a third sleeve 371 and an eighth pivot joint 372. The eighth pivot joint 372 is arranged on one side of the third sleeve 371, the left back leg 35 is movably inserted at the third sleeve 371, and the left back connection rod 36 is movably joined at the eighth pivot joint 372. Thus, when the left table leg 3 is unfolded or folded, the left front leg 32 and the left front connection rod 33 are moved with the coordination of the second sleeve 341 and the seventh pivot joint 342 of the left front sliding member 34, and the left back leg 35 and the left back connection rod 36 are moved with the coordination of the third sleeve 371 and the eighth pivot joint 372 of the left back sliding member 37, further providing the left folding mechanism 2 and the left table leg 3 with better stability and bearing ability when unfolded in addition to achieving the effect of smoothly moving the left folding mechanism 2 and the left table leg 3.

As shown in FIG. 1 to FIG. 3, in one embodiment of the present disclosure, the right folding seat 41 is provided with a second rotating shaft 411, a ninth pivot joint 412, a tenth pivot joint, 413, an eleventh pivot joint 414, a twelfth pivot joint 415 and a fourth sleeve 416. The second rotating shaft 411 is arranged on an outer side of the right folding seat 41, the eleventh pivot joint 414 is arranged on one end of the right folding seat 41, the twelfth pivot joint 415 is arranged on the other end of the right folding seat 41, the ninth pivot joint 412 is adjacent to the eleventh pivot joint 414, and the tenth pivot joint 413 is adjacent to the twelfth pivot joint 415. The second rotating shaft 411 is movably joined at the right inclined support 42, the first right beam 43 has one end movably joined at the ninth pivot joint 412, the second right beam 44 has one end movably joined at the tenth pivot joint 413, the right front leg 52 has one end movably joined at the eleventh pivot joint 414, the right back leg 55 has one end movably joined at the twelfth pivot joint 415, and the right telescopic rod 51 has one end sleeved at the fourth sleeve 416. Thus, when the present disclosure is folded or unfolded, the right inclined support 42, the first right beam 43, the second right beam 44, the right telescopic rod 51, the right front leg 52 and the right back leg 55 can be moved with the coordination of the second rotating shaft 411, the ninth pivot joint 412, the tenth pivot joint 413, the eleventh pivot joint 414, the twelfth pivot joint 415 and the fourth sleeve 416, further providing the right folding mechanism 4 and the right table leg 5 with better stability and bearing ability when unfolded in addition to achieving the effect of smoothly moving the right folding mechanism 4 and the right table leg 5.

As shown in FIG. 1 to FIG. 3, in one embodiment of the present disclosure, the right inclined support 42 is provided with two right support cross arms 421 and two right support inclined arms 422. The right support cross arms 421 are movably joined respectively at the right support inclined arms 422 and the second rotating shaft 411, and the right telescopic rod 51 has the other end movably joined at the right support inclined arms 422. Thus, when the right inclined support 42 is folded or unfolded, with the coordination of the second rotating shaft 411, the right support cross arms 421 and the right support inclined arms 422, the right folding mechanism 4 and the right table leg 5 are provided with better stability and bearing ability when unfolded in addition to achieving the effect of smoothly moving the right folding mechanism 4 and the right table leg 5.

As shown in FIG. 1 to FIG. 3, in one embodiment of the present disclosure, the right telescopic rod 51 is provided with a right outer tube 511, a right inner tube 512, a second connection member 513, a thirteenth pivot joint 514 and a fourteenth pivot joint 515. The right inner tube 512 is sleeved in the right outer tube 511. The second connection member 513 is arranged on an outer end of the right inner tube 512, the thirteenth pivot joint 514 is arranged on one side of the second connection member 513, and the fourteenth pivot joint 515 is arranged on the other side of the second connection member 513. The right outer tube 511 has one end arranged at the right folding seat 41, and the right telescopic rod fixing portion 58 is arranged at the right outer tube 511. The right front connection rod 53 has the other end movably joined at the thirteenth pivot joint 514, and the right back connection rod 56 has the other end movably joined at the fourteenth pivot joint 515. Thus, when the right telescopic rod 51 is folded or unfolded, the right front leg 52, the right front connection rod 53, the right back leg 55 and the right back connection rod 56 can be collaterally moved with the coordination of the right outer tube 511, the right inner tube 512, the second connection member 513, the thirteenth pivot joint 514 and the fourteenth pivot joint 515, further providing the right folding mechanism 4 and the right table leg 5 with better stability and bearing ability when unfolded in addition to achieving the effect of smoothly moving the right folding mechanism 4 and the right table leg 5.

As shown in FIG. 1 to FIG. 4, in one embodiment of the present disclosure, the right telescopic rod fixing portion 58 includes a second seat 581, a second latch pin 582, a second elastic member 583 and a second pull member 584. The second seat 581 is located on one end of the right outer tube 511. The second latch pin 582 is arranged at the second seat 581. The second elastic member 583 is arranged between the second seat 581 and the second latch pin 582. The second pull member 584 is arranged at the second latch pin 582. A third limiting hole 5111 and a fourth limiting hole 5112 corresponding to each other are respectively provided at the right outer tube 511 and the right inner tube 512. The second latch pin 582 is fastened with or unfastened from the third limiting hole 5111 and the fourth limiting hole 5112. Thus, when the right table leg 5 is folded or unfolded, the second pull member 584 of the right telescopic rod fixing portion 58 is used to drive the second latch pin 582 (and to cause the second elastic member 583 to be in a compressed or expanded state), so as to limit or release the right outer tube 511 and the right inner tube 512 of the right telescopic rod 51, allowing the right telescopic rod 51 to act and drive the right inclined support 42, the second right beam 43, the second right beam 44, the right front leg 52, the right front connection rod 53, the right back leg 55 and the right back connection rod 56, further providing the right folding mechanism 4 and the right table leg 5 with better stability and bearing ability when unfolded in addition to achieving the effect of a smooth movement for the right folding mechanism 4 and the right table leg 5.

As shown in FIG. 1 to FIG. 3, in one embodiment of the present disclosure, the right front sliding member 54 includes a fifth sleeve 541 and a fifteenth pivot joint 542. The fifteenth pivot joint 542 is arranged on one side of the fifth sleeve 541, the right front leg 52 is movably inserted at the fifth sleeve 541, and the right front connection rod 53 is movably joined at the fifteenth pivot joint 542. The right back sliding member 57 includes a sixth sleeve 571 and a sixteenth pivot joint 572. The sixteenth pivot joint 572 is arranged on one side of the sixth sleeve 571, the right back leg 55 is movably inserted at the sixth sleeve 571, and the right back connection rod 56 is movably joined at the sixteenth pivot joint 572. Thus, when the right table leg 5 is unfolded or folded, the right front leg 52 and the right front connection rod 53 are moved with the coordination of the fifth sleeve 541 and the fifteenth pivot joint 542 of the right front sliding member 54, and the right back leg 55 and the right back connection rod 56 are moved with the coordination of the sixth sleeve 571 and the sixteenth pivot joint 572 of the right back sliding member 57, further providing the right folding mechanism 4 and the right table leg 5 with better stability and bearing ability when unfolded in addition to achieving the effect of smoothly moving the right folding mechanism 4 and the right table leg 5.

Figure 13:
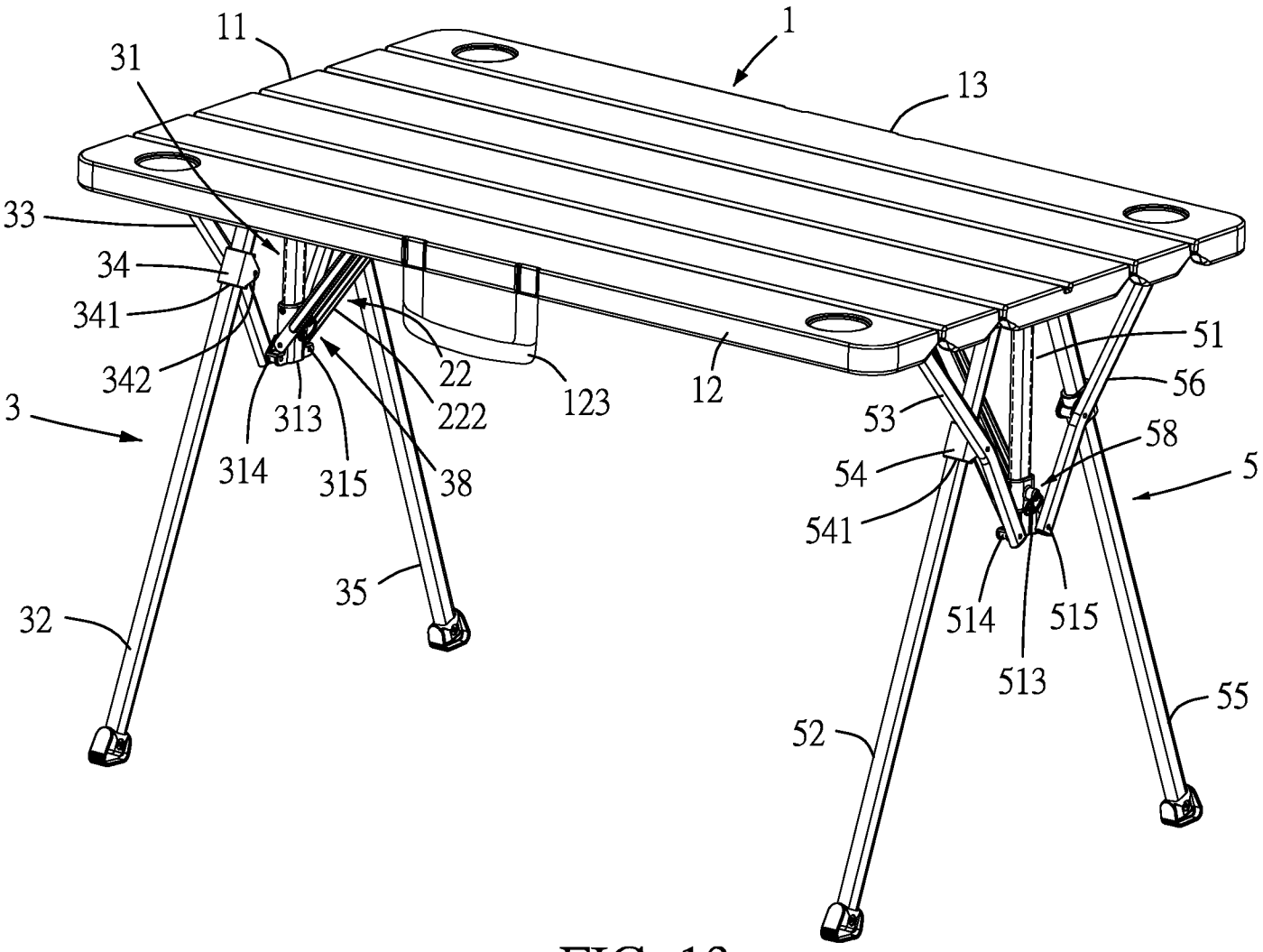
FIG. 13 is a three-dimensional schematic diagram of an appearance according to another embodiment of the present disclosure.
Figure 14:
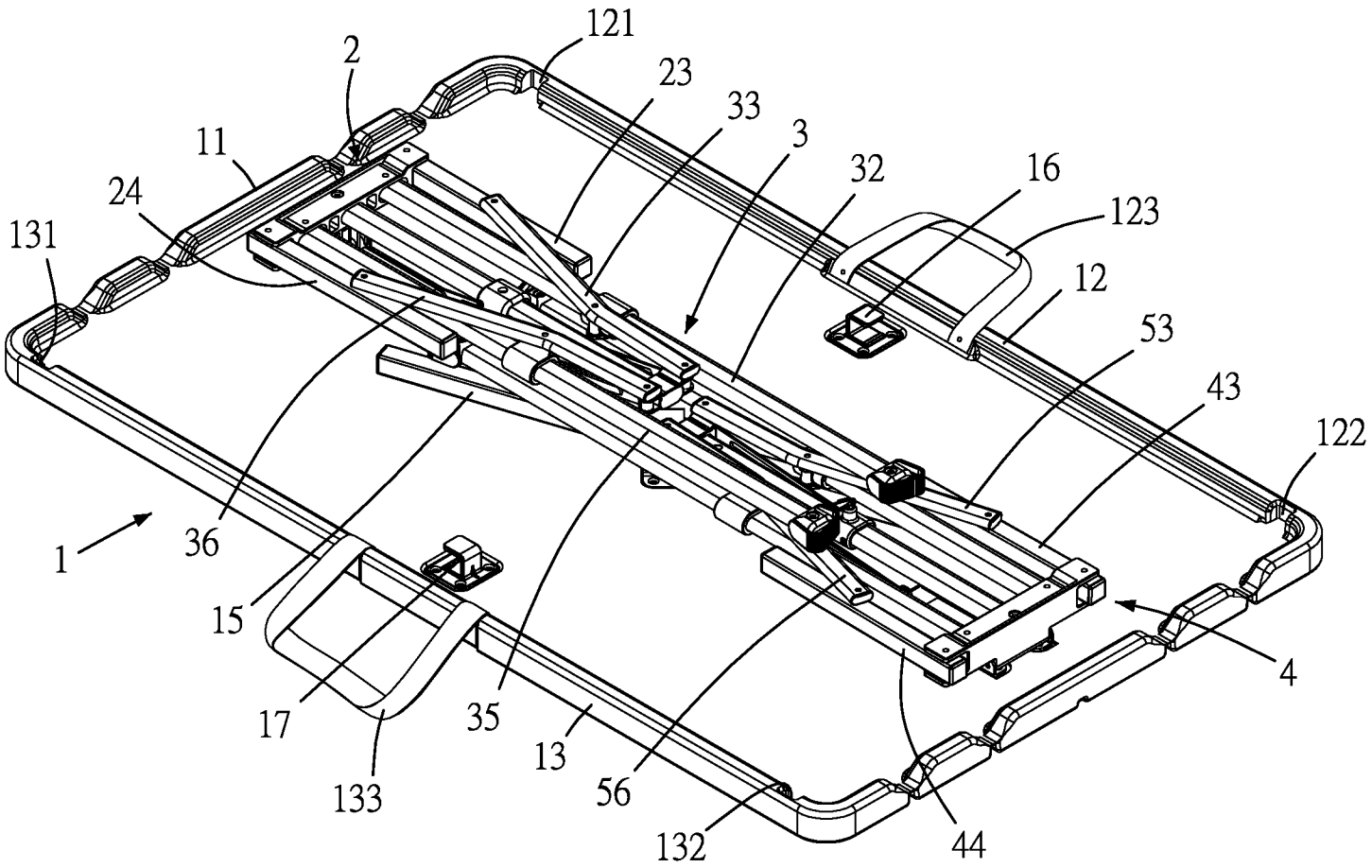
FIG. 14 is a first schematic diagram of a folded state according to another embodiment of the present disclosure.
Figure 15:
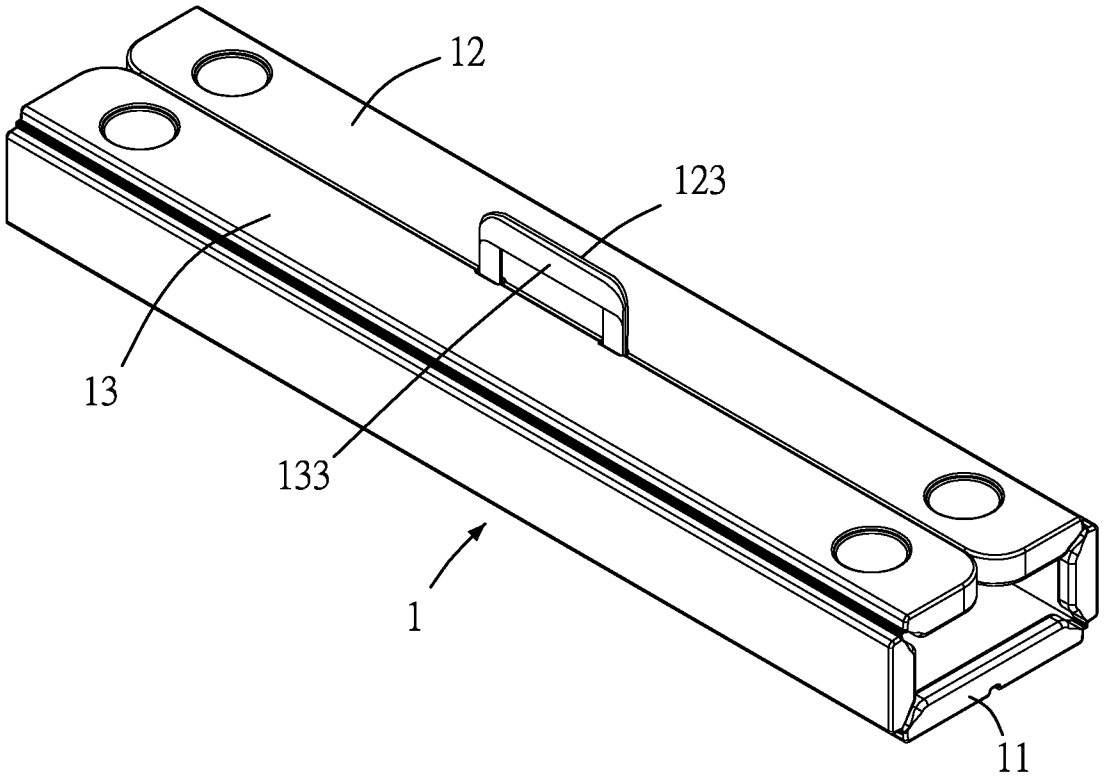
FIG. 15 is a second schematic diagram of a folded state according to another embodiment of the present disclosure.

As shown in FIG. 13 to FIG. 15, in one embodiment of the present disclosure, a first handle 123 is arranged on one side of the first folding table panel 12, and a second handle 133 is arranged on one side of the second folding table panel 13. Thus, once the left table leg 3 and the right table leg 5 are folded, the first folding table panel 12 and the second folding table panel 13 can be folded in a direction toward the center table panel 11, such that the center table panel 11, the first folding table panel 12 and the second folding table panel 13 can envelope the left folding mechanism 2, the left table leg 3, the right folding mechanism 4 and the right table leg 5. Thus, the folding table appears as a long stripe shape and has a rectangular (quadrilateral) cross section, and the first handle 123 and the second handle 133 are mutually and correspondingly connected for exerting a force for the use of picking up or carrying, allowing the present disclosure to provide effects of a minimal occupied space and ease of portability when folded.

The present disclosure is described by way of the preferred embodiments above. A person skilled in the art should understand that, these embodiments are merely for describing the present disclosure are not to be construed as limitations to the scope of the present disclosure. It should be noted that all equivalent changes, replacements and substitutions made to the embodiments are to be encompassed within the scope of the present disclosure. Therefore, the scope of protection of the present disclosure should be accorded with the broadest interpretation of the appended claims.

What is claimed is:

1. A folding table, comprising:

a tabletop, comprising a center table panel, a first folding table panel and a second folding table panel, the first folding table panel movably joined on one side of the center table panel, and the second folding table panel movably joined on one other side of the center table panel;

a left folding mechanism, arranged on one side of a bottom surface of the center table panel, the left folding mechanism comprising a left folding seat, a left inclined support, a first left beam and a second left beam, the left folding seat arranged at the bottom surface of the center table panel and having an extension section, the left inclined support having one end movably joined at the left folding seat and pressing against the bottom surface of the center table panel, the first left beam and the second left beam respectively movably joined on two sides of the left folding seat and pressing against the bottom surface of the center table panel;

a left table leg, arranged at the left folding mechanism, the left table leg comprising a left telescopic rod, a left front leg, a left front connection rod, a left front sliding member, a left back leg, a left back connection rod, a left back sliding member and a left telescopic rod fixing portion, the left telescopic rod having one end arranged at the left folding seat and one other end movably joined one other end of the left inclined support, the left front leg having one end movably joined at the left folding seat, the left front connection rod having one end movably joined at the first left beam and one other end movably connected to one other end of the left telescopic rod, the left front leg sleeved at the left front sliding member, the left front connection rod movably joined at the left front sliding member, the left back leg having one end movably joined at the left folding seat, the left back connection rod having one end movably joined at the second left beam and one other end movably joined at one other end of the left telescopic rod, the left back leg sleeved at the left back sliding member, the left back connection rod movably joined at the left back sliding member, and the left telescopic rod fixing portion arranged at the left telescopic rod;

a right folding mechanism, arranged on one other side of the bottom surface of the center table panel, the right folding mechanism comprising a right folding seat, a right inclined support, a first right beam and a second right beam, the right folding seat arranged at the bottom surface of the center table panel and being shorter than the left folding seat, the right inclined support having one end movably joined at the right folding seat and pressing against the bottom surface of the center table panel, the first right beam and the second right beam respectively movably joined on two sides of the right folding seat and pressing against the bottom surface of the center table panel; and a right table leg, arranged at the right folding mechanism, the right table leg comprising a right telescopic rod, a right front leg, a right front connection rod, a right front sliding member, a right back leg, a right back connection rod, a right sliding member and a right telescopic rod fixing portion, the right telescopic rod having one end arranged at the right folding seat and one other end movably joined one other end of the right inclined support, the right front leg having one end movably joined at the right folding seat, the right front connection rod having one end movably joined at the first right beam and one other end movably connected to one other end of the right telescopic rod, the right front leg sleeved at the right front sliding member, the right front connection rod movably joined at the right front sliding member, the right back leg having one end movably joined at the right folding seat, the right back connection rod having one end movably joined at the second right beam and one other end movably joined at one other end of the right telescopic rod, the right back sliding member sleeved at the right back leg, the right back sliding member movably joined at the right back connection rod, and the right telescopic rod fixing portion arranged at the right telescopic rod.

2. The folding table according to claim 1, wherein the tabletop further comprises a bottom support bar, which is movably joined at the bottom surface of the center table panel by a pivot portion.

3. The folding table according to claim 2, wherein a first limiting portion is arranged at a bottom surface of the first folding table panel, a second limiting portion is arranged at a bottom surface of the second folding table panel, and two ends of the bottom support bar are respectively embedded into the first limiting portion and the second limiting portion.

4. The folding table according to claim 1, wherein a first fastening portion and a second fastening portion are arranged at a bottom surface of the first folding table panel, a third fastening portion and a fourth fastening portion are arranged at a bottom surface of the second folding table panel, the first left beam and the second left beam are respectively fastened at the first fastening portion and the third fastening portion, and the first right beam and the second right beam are respectively fastened at the second fastening portion and the fourth fastening portion.

5. The folding table according to claim 1, wherein the left folding seat is provided with a first rotating shaft, a first pivot joint, a second pivot joint, a third pivot joint, a fourth pivot joint and a first sleeve; the first rotating shaft is arranged on an outer side of the left folding seat, the third pivot joint is arranged on one end of the left folding seat, the fourth pivot joint is arranged on one other end of the left folding seat, the first pivot joint is adjacent to the third pivot joint, and the second pivot joint is adjacent to the fourth pivot joint; the first rotating shaft is movably joined at the left inclined support, the first left beam has one end movably joined at the first pivot joint, the second left beam has one end movably joined at the second pivot joint, the left front leg has one end movably joined at the third pivot joint, the left back leg has one end movably joined at the fourth pivot joint, and the left telescopic rod has one end sleeved at the first sleeve.

6. The folding table according to claim 5, wherein the left inclined support is provided with two left support cross arms and two left support inclined arms, the left support cross arms are movably joined respectively at the left support inclined arms and the first rotating shaft, and the left telescopic rod has the other end movably joined at the left support inclined arms.

7. The folding table according to claim 1, wherein the left telescopic rod is provided with a left outer tube, a left inner tube, a first connection member, a fifth pivot joint and a sixth pivot joint; the left inner tube is sleeved in the left outer tube, the first connection member is arranged on an outer end of the left inner tube, the fifth pivot joint is arranged on one side of the first connection member, the sixth pivot joint is arranged on one other side of the first connection member, one end of the left outer tube is arranged at the left folding seat, the left telescopic rod fixing portion is arranged at the left outer tube, the left front connection rod has the one other end movably joined at the fifth pivot joint, and the left back connection rod has the one other end movably joined at the sixth pivot joint.

8. The folding table according to claim 7, wherein the left telescopic rod fixing portion comprises a first seat, a first latch pin, a first elastic member and a first pull member; the first seat is located on one end of the left outer tube, the first latch pin is arranged at the first seat, the first elastic member is arranged between the first seat and the first latch pin, and the first pull member is arranged at the first latch pin; a first limiting hole and a second limiting hole corresponding to each other are provided at the left outer tube and the left inner tube, and the first latch pin is fastened with or unfastened from the first limiting hole and the second limiting hole.

9. The folding table according to claim 1, wherein the left front sliding member comprises a second sleeve and a seventh pivot joint; the seventh pivot joint is arranged on one side of the second sleeve, the left front leg is movably inserted at the second sleeve, and the left front connection rod is movably joined at the seventh pivot joint.

10. The folding table according to claim 1, wherein the left back sliding member comprises a third sleeve and an eighth pivot joint; the eighth pivot joint is arranged on one side of the third sleeve, the left back leg is movably inserted at the third sleeve, and the left back connection rod is movably joined at the eighth pivot joint.

11. The folding table according to claim 1, wherein the right folding seat is provided with a second rotating shaft, a ninth pivot joint, a tenth pivot joint, an eleventh pivot joint, a twelfth pivot joint and a fourth sleeve; the second rotating shaft is arranged on an outer side of the right folding seat, the eleventh pivot joint is arranged on one end of the right folding seat, the twelfth pivot joint is arranged on one other end of the right folding seat, the ninth pivot joint is adjacent to the eleventh pivot joint, and the tenth pivot joint is adjacent to the twelfth pivot joint; the second rotating shaft is movably joined at the right inclined support, the first right beam has one end movably joined at the ninth pivot joint, the second right beam has one end movably joined at the tenth pivot joint, the right front leg has one end movably joined at the eleventh pivot joint, the right back leg has one end movably joined at the twelfth pivot joint, and the right telescopic rod has one end sleeved at the fourth sleeve.

12. The folding table according to claim 11, wherein the right inclined support is provided with two right support cross arms and two right support inclined arms, the right support cross arms are movably joined respectively at the right support inclined arms and the second rotating shaft, and the right telescopic rod has the other end movably joined at the right support inclined arms.

13. The folding table according to claim 1, wherein the right telescopic rod is provided with a right outer tube, a right inner tube, a second connection member, a thirteenth pivot joint and a fourteenth pivot joint; the right inner tube is sleeved in the right outer tube, the second connection member is arranged on an outer end of the right inner tube, the thirteenth pivot joint is arranged on one side of the second connection member, the fourteenth pivot joint is arranged on the other side of the second connection member, the right outer tube has one end arranged at the right folding seat, the right telescopic rod fixing portion is arranged at the right outer tube, the right front connection rod has the one other end movably joined at the thirteenth pivot joint, and the right back connection rod has the one other end movably joined at the fourteenth pivot joint.

14. The folding table according to claim 13, the right telescopic rod fixing portion comprises a second seat, a second latch pin, a second elastic member and a second pull member; the second seat is located on one end of the right outer tube, the second latch pin is arranged at the second seat, the second elastic member is arranged between the second seat and the second latch pin, and the second pull member is arranged at the second latch pin; a third limiting hole and a fourth limiting hole corresponding to each other are respectively provided at the right outer tube and the right inner tube, and the second latch pin is fastened with or unfastened from the third limiting hole and the fourth limiting hole.

15. The folding table according to claim 1, wherein the right front sliding member comprises a fifth sleeve and a fifteenth pivot joint; the fifteenth pivot joint is arranged on one side of the fifth sleeve, the right front leg is movably inserted at the fifth sleeve, and the right front connection rod is movably joined at the fifteenth pivot joint.

16. The folding table according to claim 1, wherein the right back sliding member comprises a sixth sleeve and a sixteenth pivot joint; the sixteenth pivot joint is arranged on one side of the sixth sleeve, the right back leg is movably inserted at the sixth sleeve, and the right back connection rod is movably joined at the sixteenth pivot joint.

17. The folding table according to claim 1, wherein a first handle is arranged on one side of the first folding table panel, and a second handle is arranged on one side of the second folding table panel.

* * * * *